US006308925B1

(12) United States Patent
Wilcox

(10) Patent No.: US 6,308,925 B1
(45) Date of Patent: Oct. 30, 2001

(54) BOX EASEL

(76) Inventor: James F. Wilcox, P.O. Box 712, Jackson, WY (US) 83001

( * ) Notice: Subject to any disclaimer, the term of this patent is extended or adjusted under 35 U.S.C. 154(b) by 0 days.

(21) Appl. No.: 09/537,856

(22) Filed: Mar. 28, 2000

(51) Int. Cl.[7] ..... A47B 97/04
(52) U.S. Cl. ..... 248/463
(58) Field of Search ..... 248/460, 461, 248/462, 463, 464, 465

(56) References Cited

U.S. PATENT DOCUMENTS 3,168,363 * 2/1965 Monsour ..... 312/231
4,042,203 * 8/1977 Warkentin ..... 248/449
5,399,009 * 3/1995 Hiner ..... 312/231

FOREIGN PATENT DOCUMENTS

2086219 * 5/1982 (GB) ..... 312/231

* cited by examiner

*Primary Examiner*—Ramon O. Ramirez
(74) *Attorney, Agent, or Firm*—Hopkins Roden Crockett Hansen & Hoopes, PLLC

(57) ABSTRACT

A fully adjustable paint box and easel which folds into a compact, light portable box shape for carrying. The novel tripod head assembly allows the outer legs to rotate out, the middle leg to rotate down, the painting holder assembly to rotate up, and the paint box to open forming a painter's easel.

17 Claims, 7 Drawing Sheets

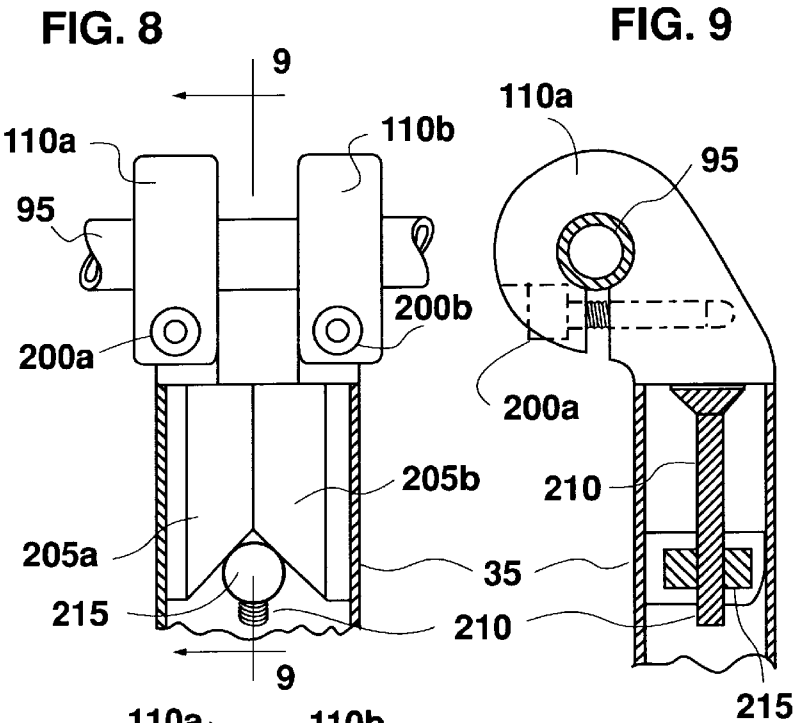
FIG. 9
FIG. 8
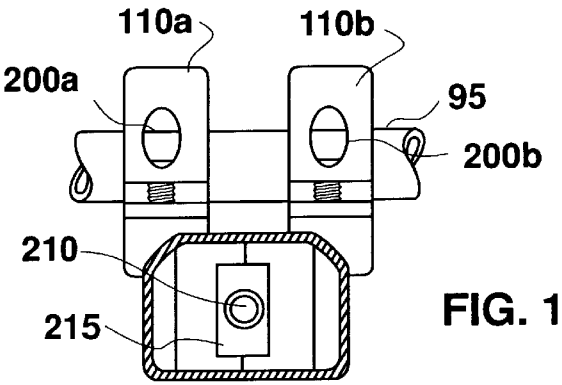
FIG. 10
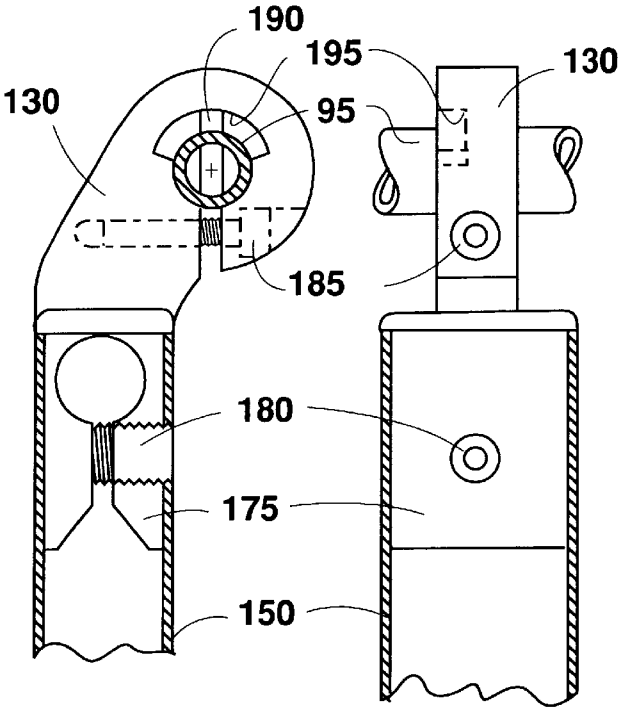
FIG. 7
FIG. 6

20
225
220
245
240
235
30
40
250
280
13
35
25
27 0
12
255
260
265
230

275
285

270

BOX EASEL

TECHNICAL FIELD

This invention relates in general to an artist's combined paint box and easel assembly mounted on a folding tripod assembly that is easily opened and folded up for carrying. A combined paint box and easel assembly is commonly called a box easel in the trade.

BACKGROUND OF THE INVENTION

There are many types of portable and folding easels and tripods that can hold a painter's canvas, palette tubes, and brushes, etc. In most applications of folding easels and tripods, there are many devices which protrude even in the folded position, i.e., knobs, screws, wing nuts, lock pins and painting holder pins, etc. These protrusions are undesirable since they may injure the carrier or hook onto adjacent structures or objects. Additionally, they can fall off and become lost.

SUMMARY OF THE INVENTION

It is the purpose of this invention to provide a fully adjustable tripod mounted box easel which can support painting holders, a paint box and painting supplies. It is also a purpose of this invention to provide a combined easel and painter's box that folds up and has an absolute minimum of protruding devices that can fall off and become lost, or present protrusions when in the folded or stored position. It is also a purpose to provide compact and light devices that are easily and quickly operated.

The invention consists of tripod legs, a tripod head assembly, a painters box and a painting holder assembly.

The tripod head assembly supports a folding paint box which unfolds and opens up to give access to containers of paint pigment, brushes and storage, etc. The head assembly also supports a painting holder assembly having adjustable upper and lower arms each having novel adjustable painting holders that retract close to the arms when not in use. The paint box and easel fold into a compact rectangular box shape of 2⅝ inches by 12½ inches by 19½ inches length. The weight is about 9 pounds and can be set up in less than half a minute.

The adjustability permits converting from tripod support to a lap-top or table-top easel. The paint holder assembly supports paintings up to 30 inches high. Tripod legs are fully adjustable and have touch adjustments for quick setup and take down. These telescopic legs are covered by patent application Ser. No. 08/910,835 and utilize a push button to retract the legs.

Other objects, advantages, and capabilities of the present invention will become more apparent as the description proceeds.

BRIEF DESCRIPTION OF THE DRAWINGS

FIG. 6 is a side elevation of the middle leg clamp.

FIG. 7 is a front elevation of the middle leg clamp.

FIG. 8 is a front elevation of the two post clamps.

FIG. 9 is a section view taken along lines 9—9 of FIG. 8.

FIG. 10 is a bottom view of the two post clamps.

DETAILED DESCRIPTION OF THE INVENTION

Figure 1:
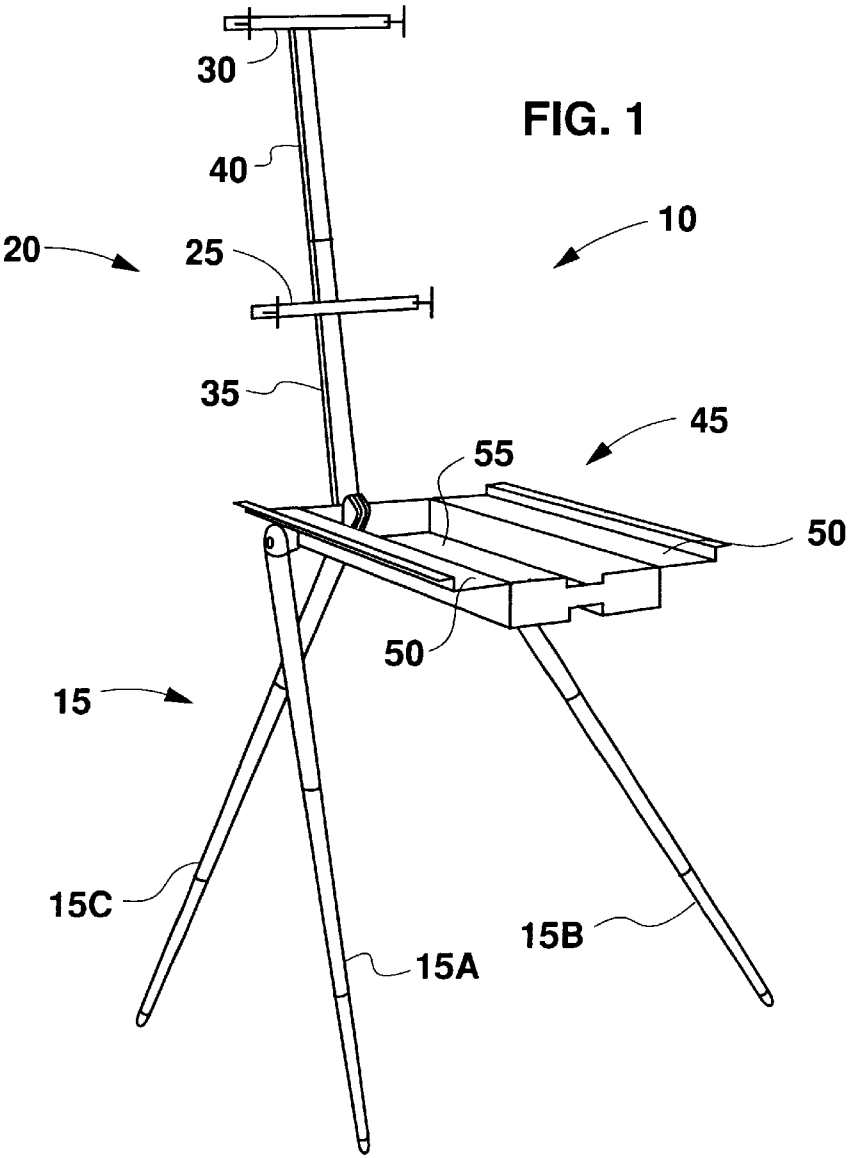
FIG. 1 is a front perspective view of the portable box easel of the present invention.

FIG. 1 illustrates the box easel 10 in an open position, supported by telescopic tripod legs 15. The paint holder assembly 20 consists of the lower crossbar 25, upper crossbar 30, post 35 and post extension 40. The paint box 45 is illustrated with the lids 50 in the open position permitting access to stored materials, i.e. paints, brushes, tools and the palette 55.

Figure 2:
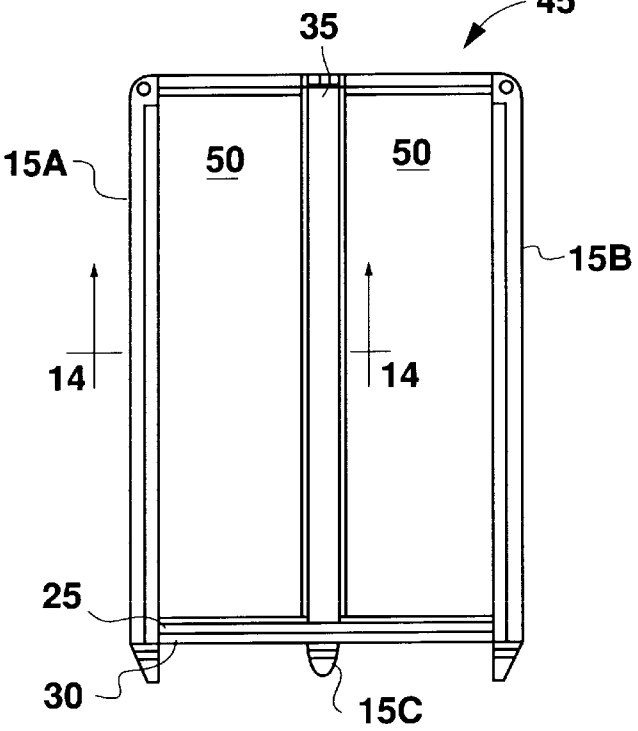
FIG. 2 is a plan view of the easel in a folded position.

FIG. 2 illustrates the compact box easel 10 in the folded position in plan view. In this position, outer legs 15*a* and 15*b* are folded into the side of paint box 45 and middle leg 15*c* is folded up from underneath the paint box. The post extension 40 is retracted within post 35 and the post 35 is folded down over a flange of each lid 50. Crossbar 25 is raised to an upper position before folding post 35 and when folded, crossbars 25 and 30 are shown at the ends of paint box 45. In this folded position, the overall dimensions are approximately 2½ inches by 12½ inches by 19½ for easy carrying and storage.

Figure 3:
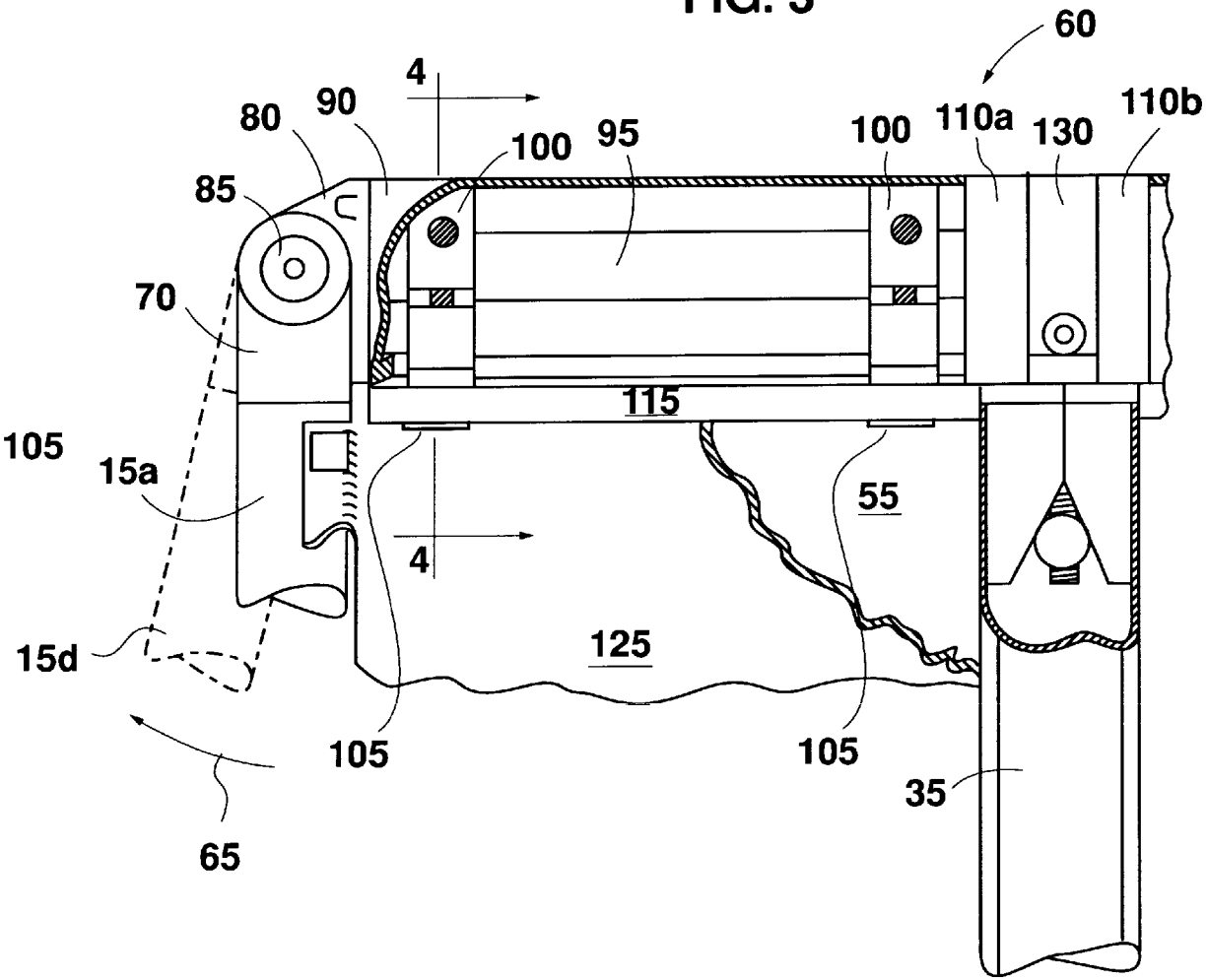
FIG. 3 is a partial section plan view of the easel tripod head assembly in the folded position.

FIG. 3 illustrates the easel head assembly 60 in a cutaway section with the lids 50 removed. Leg 15*a* and post 35 are shown in their folded positions. (Leg 15*d* shows the "open" position for leg 15*a* when rotated as at arrow 65.) Leg clevis 70 inserts within leg tube of leg 15*a* and is attached to the axle block 80 by adjustable screw 85. End cap 90 is shown cutaway to reveal the interior parts of head assembly 60. Axle 95 rotatably supports a pair of box clamps 100. The clamping force of these clamps 100 is adjustable by box clamp screw 105 (one shown). Post clamps 110*a* and mirror image 110*b* connect post 35 to easel head assembly 60.

Figure 4:
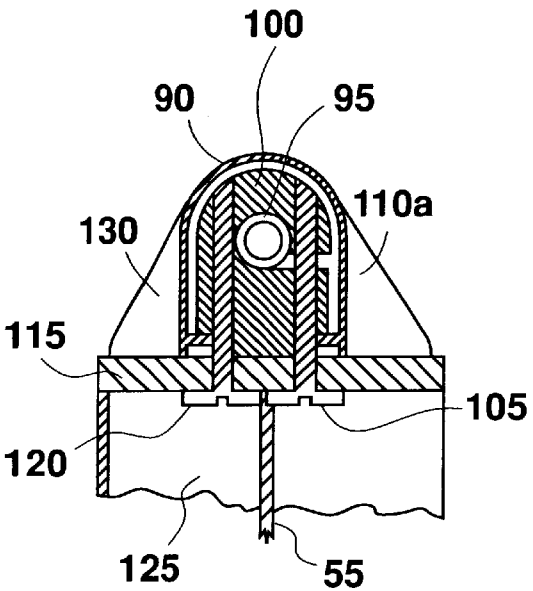
FIG. 4 is a section view taken through lines 4—4 of FIG. 3.

FIG. 4 illustrates the box clamp 100 connection between axle 95 and box end 115. Screw 120 and adjustable box clamp screw 105 affix the box clamp 100 to the box end 115 and hold down the end cap 90 against the box end 115. FIGS. 3 and 4 also illustrate the palette 55 located within box 125. The middle leg clamp 130 is shown rotatably attached to axle 95.

Figure 5:
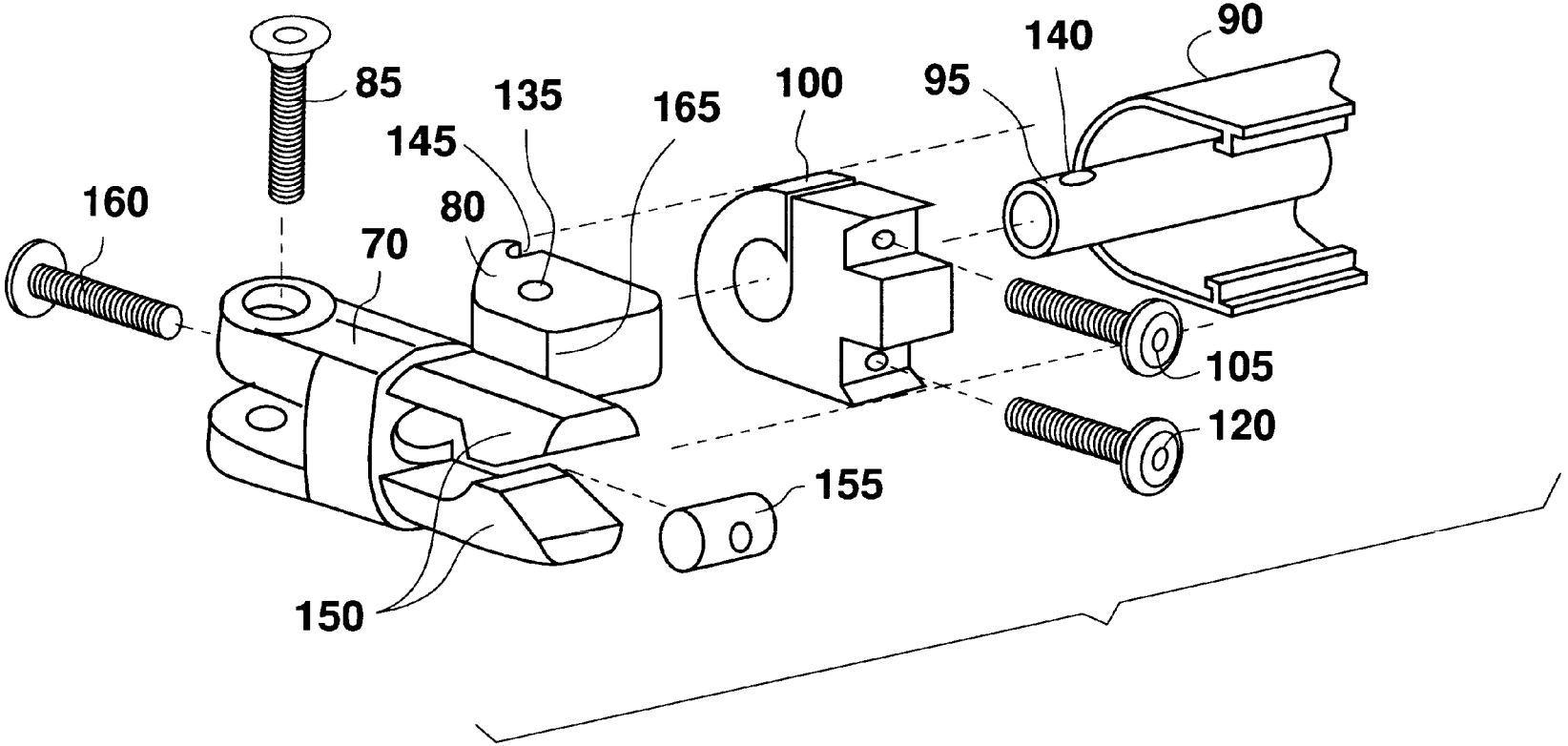
FIG. 5 is a front exploded perspective view of the easel tripod head.

The exploded view FIG. 5 illustrates in further detail the easel head assembly 60. Axle 95 passes through the box clamp 100 and terminates in axle block 80. The axle 95 is restrained within block 80 by clevis screw 85 which penetrates axle block hole 135 and axle hole 140. Slot 145 in the axle block 80 may be used for a carrying strap.

The leg clevis 70 has two expansion prongs 150 which engage dowel nut 155 which engages screw 160. Tightening screw 160 spreads prongs 150 by pulling dowel nut 155 against the prongs 150. The prongs 150 engage the interior of leg tube 15*a* (FIG. 3). Rotation of leg clevis 70 and leg tube 75 is stopped when edge 165 of axle block 80 engages an interior section of leg clevis 70.

FIGS. 6 and 7 illustrate the side and front elevation of the middle leg 130. The tube of middle leg 15*c* (section view) is firmly engaged by leg prongs 175 that are expanded by set screw 180. The clamping force of middle leg clamp is adjusted by middle leg clamp screw 185 and rotation of middle leg clamp 130 and the middle leg is stopped in two directions by stop pin 190 within slot 195. The clamp 130 and pin 190, as shown, is in the folded position. Clamp screw 185 is easily adjustable when the easel is in the open or folded position.

FIGS. 8, 9 and 10 illustrate the details of the two post clamps 110*a* and 110*b* which are mirror images and clamp as shown on axle 95. The clamping force on the axle which restricts rotary motion of the post 35 is controlled by post clamp screws 200*a* and 200*b*.

The post 35 is firmly clamped internally by post prongs 205*a* and 205*b* which are spread by tightening prong clamp screw 210 within threaded dowel nut 215. Post clamping screws 200*a* and 200*b* are accessible when the post 35 is in the open and upright position.

Figures 11, 12, 13:
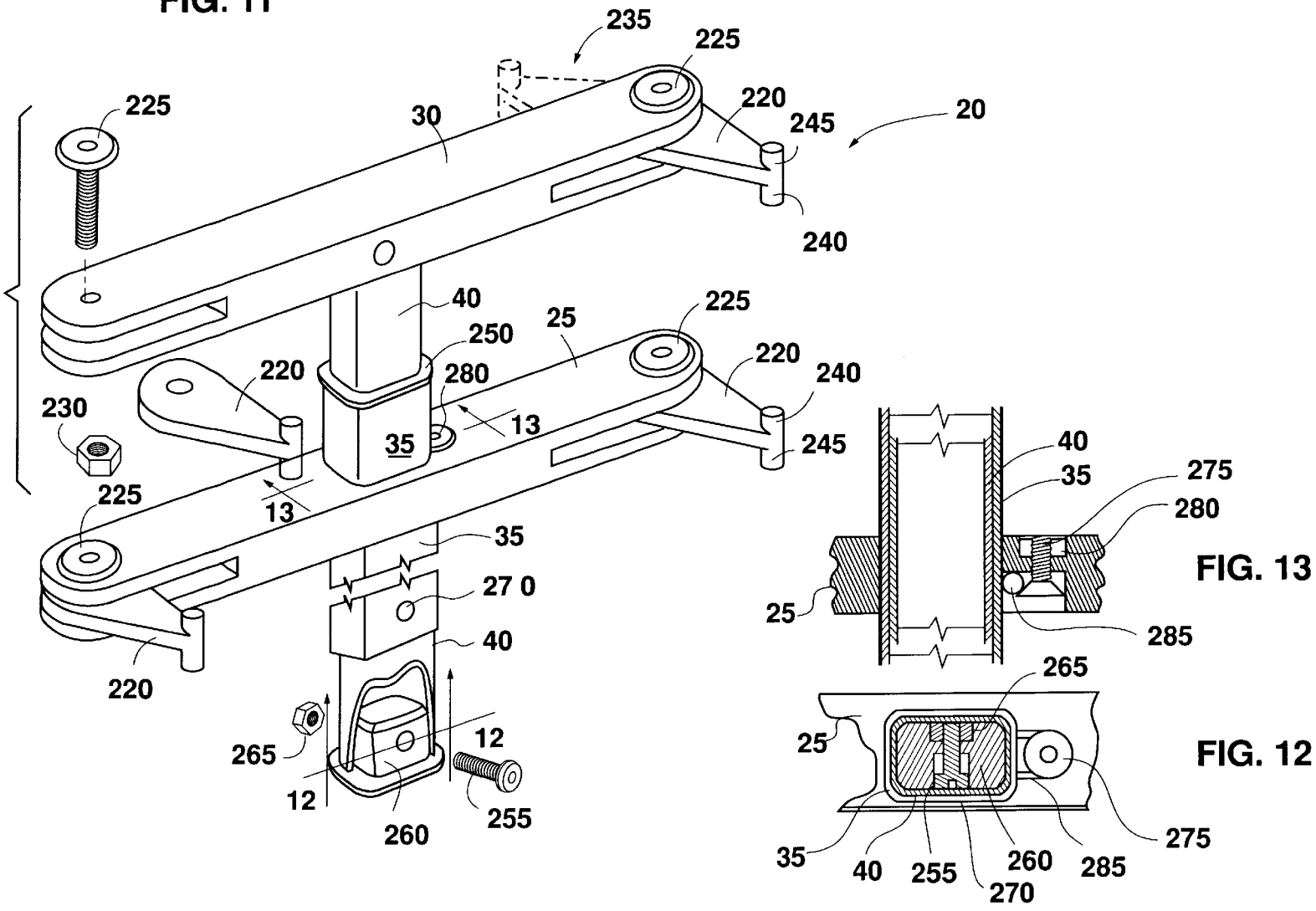
FIG. 11 is a front perspective view of the painting holder assembly.
FIG. 12 is a section view taken along lines 12—12 of FIG. 11.
FIG. 13 is a section view taken along lines 13—13 of FIG. 11.

FIG. 11 illustrates details of the painting holder assembly 20 in the open and upright position. The upper and lower crossbars 30 and 25 have similar painting holders 220 at each end. The painting holders 220 are each held in place by screw 225 and nut 230 which is in a shaped hole so it will not rotate. Painting holders 220 can swivel over 180° to a back position 235 as shown in phantom to permit mounting a painting from the back side of assembly 20. The painting holders 220 each have an inner peg 240 and an outer peg 245. Whichever peg is used to hold a painting, the opposite peg can be used to make adjustments and avoid getting paint on the fingers.

The upper crossbar 30 is firmly affixed to post extension 40 which slides up or down within post 35 and plastic post glide 250. The clamping friction force between post 35 and post extension 40 is adjusted by post extension clamp screw 255 within lower post plastic glide 260 that engages nut 265. Clockwise screw motion causes the plastic screw to bear against inner surface of the post 35, as best seen in FIG. 12, thereby clamping post extension 40 against post 35. Access to screw 255 for adjustment is through aperture 220.

Referring to FIG. 13, the sliding friction of the lower crossbar 25 on post 35 is adjusted by tightening screw 275 within nut 280 thereby compressing dowel 285 against post 35.

Figure 14:
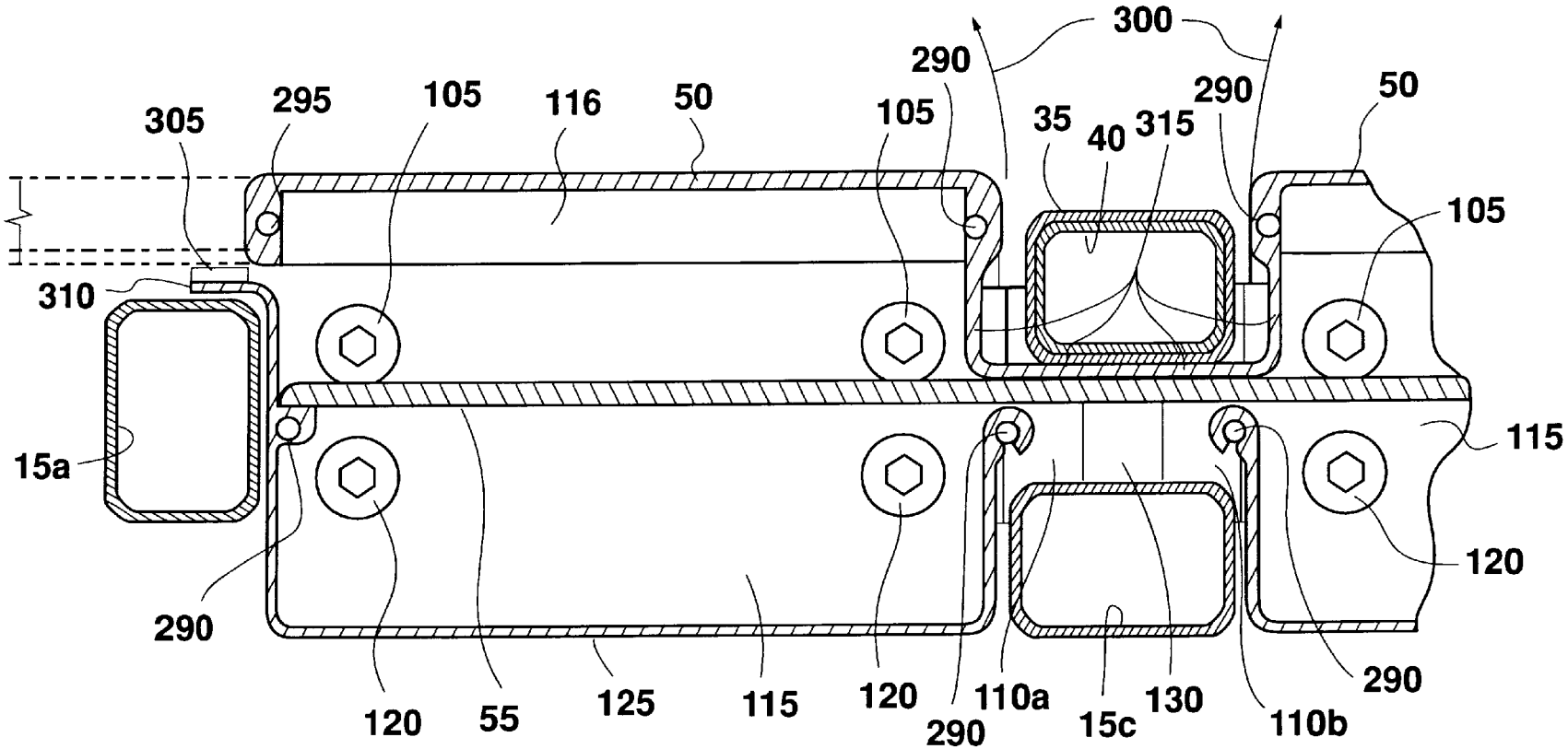
FIG. 14 is a front section view taken along lines 14—14 of FIG. 2.

FIG. 14 illustrates details of the box 125 with the lids 50, tripod legs 15*a* and 15*c*, and posts 35 and 40 in the folded position. This view and FIG. 2 illustrate the extremely compact configuration of elements of this paint box and easel.

The box 125, having a channel shape, is affixed by fasteners 290 to box end 115 and has a hinge pin 295 supporting lid 50. It is necessary to raise the posts 35 and 40 to permit opening lids 50. When lids 50 are rotated about 180° to open position as at arrow 300 and as shown on FIG. 1, the lids 50 rest on bumper 305 attached to flange 310 thereby allowing access to the palette 55. In the open position of the lids 50, the lid flanges 315 and lid ends 116 (FIG. 14) prevent the various painters tools on the inverted lid from falling off.

Figure 15:
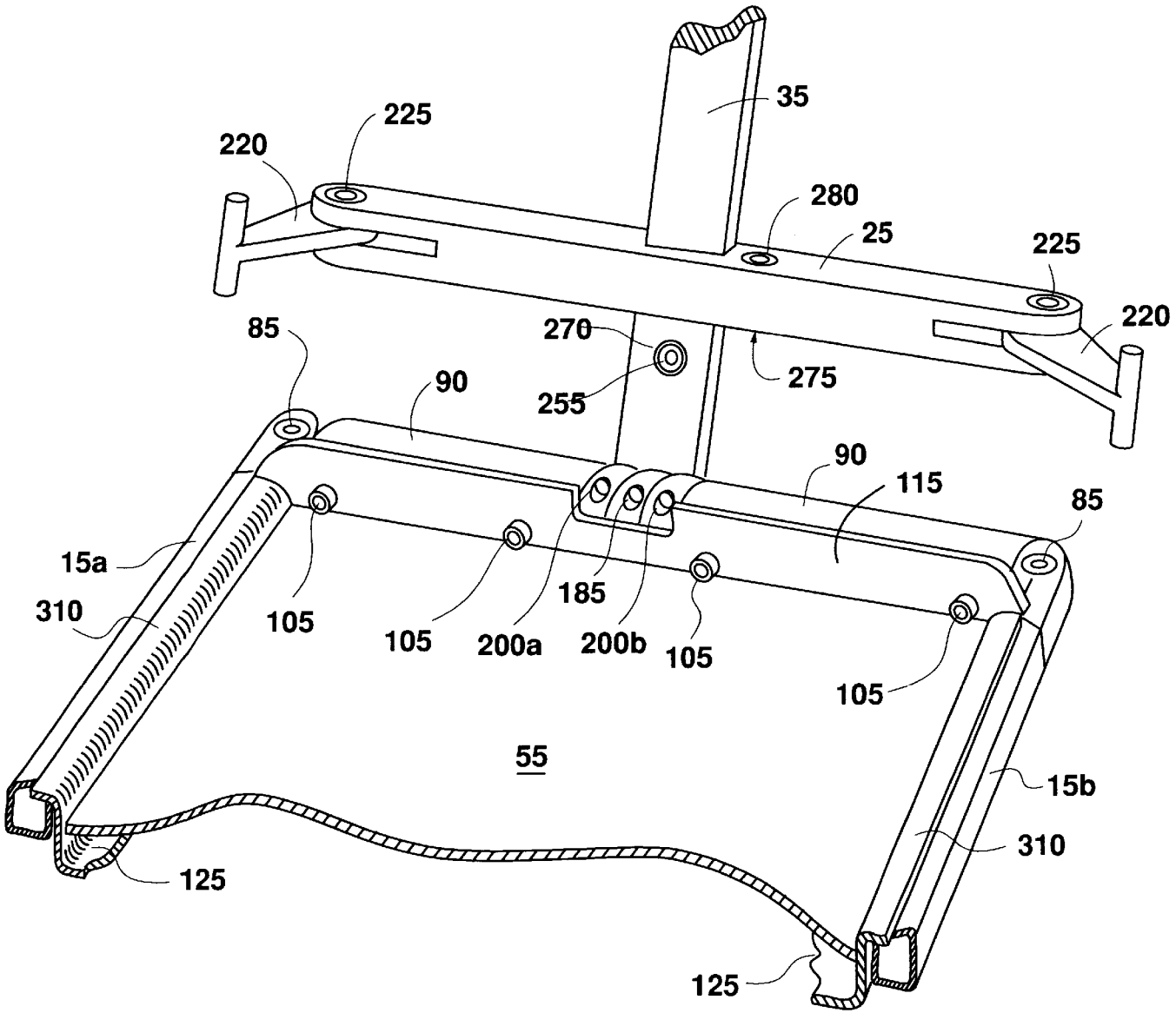
FIG. 15 is a front perspective view of the box and painting holder assembly.

FIG. 15 illustrates the multiple socket screw adjustment points on the paint box and easel while in the open position. Here, the box lids are removed for clarity.

The rotatable painting holders 220 can be adjusted for rotating friction at socket screw 225. The lower crossbar 25 friction on post 35 is adjusted by socket screw 275, and extension post 40 friction within post 35 is adjusted through aperture 270 at screw 255.

The rotary friction force for the post is adjusted at screws 200*a* and 200*b* and leg clamp screw 185 in the center adjusts middle leg motion friction. The four screws 105 adjust the rotary friction of the box and palette 55 relative to the outer legs 15*a*, 15*b* and center leg 15*c*. The outer leg rotation friction adjustment is at screws 85. As seen in this view when the lids are opened and the post is raised, all Allen wrench adjustment points are clearly visible.

The materials used in construction of the box easel are space age aluminum and polymers providing light weight and durability.

What is claimed is:

1. A portable box easel comprising:

a) a tripod head assembly having an axle supported by three adjustable and folding legs, the tripod head assembly further comprising:

i) a leg clevis and axle block affixing an outer leg to each axle end;

ii) multiple box clamps rotatably attached to the axle;

iii) a middle leg clamp rotatably affixing the middle leg to the axle; and iv) a pair of post clamps rotatably affixed to the axle;

b) a paint box rotatably affixed to the multiple box clamps;

c) a painting holder assembly rotatably supported by the axle, the painting holder assembly further comprising:

i) a post rotatably affixed to the post clamps, said post having a slidable lower cross arm and rotatable painting holders; and ii) a telescopically sliding post extension within the post having an affixed upper cross arm and rotatable painting holders, wherein the tripod legs fold against sides and bottom of the paint box and the post and post extension fold flush against the top of the paint box, thereby providing compact portability.

2. The box easel of claim 1 wherein the paint box has a pair of lids that rotate to an open position.

3. The box easel of claim 1 wherein the paint box supports a removable palette.

4. The box easel of claim 1 wherein a friction force to fold the outer legs is adjusted by a screw attaching the legs to the leg clevis and axle block.

5. The box easel of claim 1 wherein a friction force to rotate the paint box is adjusted by screws in the multiple box clamps.

6. The box easel of claim 1 wherein a friction force to rotate the painting holder assembly is adjusted by a screw in each post clamp.

7. The box easel of claim 1 wherein a friction force to fold the middle leg is adjusted by a screw in the middle leg clamp.

8. The box easel of claim 1 wherein a friction force to move the telescopically sliding post extension within the post is a screw within the post extension.

9. The box easel of claim 1 wherein a friction force to slide the lower cross arm is adjusted by a screw and dowel within the cross arm.

10. The box easel of claim 1 wherein a friction force to rotate the painting holders is adjusted by a screw at each end of the upper and lower cross arms.

11. The box easel of claim 1 wherein all elements are folded against the paint box providing dimensions of approximately 2⅝ inches by 12½ inches by 19½ inches.

12. A portable box easel comprising:

a) a tripod head assembly having an axle supported by three adjustable and folding legs, the tripod head assembly further comprising:
   i) a leg clevis and axle block affixing an outer leg to each axle end;
   ii) multiple box clamps rotatably attached to the axle;
   iii) a middle leg clamp rotatably affixing the middle leg to the axle; and
   iv) a pair of post clamps rotatably affixing the post to the axle;

b) a paint box rotatably affixed to the axle;

c) a painting holder assembly rotatably supported by the axle, the painting holder assembly further comprising:
   i) a post rotatably affixed to the axle, said post having a slidable lower cross arm; and
   ii) a telescopically sliding post extension within the post having an affixed upper cross arm, wherein the tripod legs fold against sides and bottom of the paint box and the post and post extension fold flush against a top of the paint box, thereby providing compact portability.

13. The box easel of claim 12 wherein a rotatable painting holder is affixed to each end of each cross arm.

14. The box easel of claim 12 wherein the paint box is affixed to the multiple box clamps.

15. The box easel of claim 12 wherein the paint box has a pair of lids that rotate to an open position.

16. The box easel of claim 12 wherein the paint box supports a removable palette.

17. The box easel of claim 12 wherein friction forces hold the legs, paint box and painting holder assembly in varying positions and the friction forces are adjusted by multiple screws.

* * * * *